US006534113B1

(12) United States Patent
Ueberschär et al.

(10) Patent No.: US 6,534,113 B1
(45) Date of Patent: Mar. 18, 2003

(54) METHOD OF CONTROLLING THE AMOUNT OF COATING APPLIED ON A MOVING MATERIAL WEB

(75) Inventors: Manfred Ueberschär, Gerstetten (DE); Harald Hess, Grünkraut (DE); Rudolf Münch, Königsbronn (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 159 days.

(21) Appl. No.: 09/309,066

(22) Filed: May 10, 1999

(30) Foreign Application Priority Data

May 19, 1998 (DE) ..... 198 22 505

(51) Int. Cl.[7] ..... B05D 3/12

(52) U.S. Cl. ..... 427/8; 427/356; 427/359; 427/361

(58) Field of Search ..... 427/8, 9, 10, 356, 427/359, 361; 118/712, 123, 126, 413

(56) References Cited

U.S. PATENT DOCUMENTS

| | | | | |
|---|---|---|---|---|
| 5,074,243 A | | 12/1991 | Knop et al. | 118/665 |
| 5,496,407 A | * | 3/1996 | McAleavey | 118/677 |
| 5,785,253 A | | 7/1998 | Ueberschär et al. | 239/455 |
| 6,010,739 A | * | 1/2000 | Ueberschar et al. | 427/8 |

FOREIGN PATENT DOCUMENTS

| | | | |
|---|---|---|---|
| DE | 2 62 819 A1 | | 7/1987 |
| DE | 43 03 577 A1 | | 2/1993 |
| DE | 196 27 470 A1 | | 7/1996 |
| DE | 196 27 489 A1 | | 7/1996 |
| DE | 196 27 456 A1 | | 8/1996 |
| DE | 196 37 164 A1 | | 9/1996 |
| DE | 196 05 183 A1 | * | 8/1997 |
| EP | 0 642 613 B1 | | 3/1995 |
| WO | WO 96/06226 A1 | | 2/1996 |

* cited by examiner

*Primary Examiner*—Katherine A. Bareford
(74) *Attorney, Agent, or Firm*—Taylor & Aust, P.C.

(57) ABSTRACT

In a coating method for direct or indirect application of a coating medium onto a moving surface, the amount of coating medium dispensed by an applicator device within a given time period and the actuating force that is exerted on the metering element, in order to achieve a coating layer of a desired coating weight, are altered independently of each other. In a relaxation operation mode, the amount of coating medium applied within a given time period is reduced when the coating weight exceeds a desired value; when the coating weight falls below the desired value, the actuating force exerted on the metering element is reduced. In a contact pressure based operating mode, the amount of coating medium applied within a given time period is reduced when the coating weight exceeds a desired value; when the coating weight falls below the desired value the actuating force exerted on the metering element is increased. When the coating weight falls below the desired value, the amount of coating medium applied within a given time period is increased and the actuating force exerted on the metering element is reduced, while keeping constant the contact pressure of the metering element against the moving surface.

11 Claims, 3 Drawing Sheets

METHOD OF CONTROLLING THE AMOUNT OF COATING APPLIED ON A MOVING MATERIAL WEB

BACKGROUND OF THE INVENTION

1. Field of the Invention

The present invention relates to the direct or indirect application of a liquid or viscous coating medium onto a moving surface.

2. Description of the Related Art

In the case of direct application, the coating medium is applied directly to the surface of a moving material web, specifically a paper or cardboard web. In the case of indirect application, the coating medium is first applied to the surface of a moving or rotating transfer element, preferably that of a transfer roll, which then transfers the coating medium to the material web. The coating medium is applied to the moving surface by use of an applicator unit. The volume of coating medium dispensed by the applicator unit within a given time period is adjustable. A metering device includes a metering element upon which an adjustable actuating force is exerted for the purpose of adjusting the metering device against the moving surface. The metering device is located after the applicator unit, when viewed in the direction of travel of the moving surface and whereby the applied coating weight is measured.

A method of this type is described in German patent document DE 196 05 183 A1. In that method, the coating weight measurement signal is subjected to a frequency analysis and is divided into a high frequency signal portion and a low frequency signal portion. The high frequency signal portion is supplied to a regulating device for changing the actuating force that is exerted upon the metering element. The low frequency signal portion is supplied to a regulating device for changing the volume of coating medium which is dispensed in a given time period by the applicator unit.

A coating method is described in German patent document DE 196 37 164 A1 in which the coating weight is determined by influencing the actuating force exerted on the metering element, as well as by influencing the volume of coating medium that is dispensed by the applicator device within a given time period. Either the applicator device or the metering device will take over the longitudinal profiling of the coating layer that is applied to the moving surface while the other device—metering device or applicator device—will be responsible for the cross profiling of the coating layer.

SUMMARY OF THE INVENTION

The present invention reduces wear and tear of the metering element by comparing the measured coating weight to a predetermined desired value and adjusting both the volume of coating medium that is being applied and the actuating force exerted upon the metering element dependent upon the result of the comparison.

When the measured coating weight exceeds a predetermined desired value, the coating medium volume dispensed by the applicator device within a predetermined time period is reduced. When the measured coating weight drops below a predetermined desired value, the actuating force exerted upon the metering element is reduced.

The contact pressure which the metering element exerts against the moving surface—on the one hand due to the effect of the actuating force and on the other hand by the coating medium pressing against it (in the instance of a doctor blade the force exerted upon the blade tip)—decreases when reducing the actuating force that is exerted upon the metering element. The contact pressure exerted by the metering device also is reduced when the amount of coating medium dispensed by the applicator device within a given time period is reduced. Wear and tear of the metering element, however, also depends on the magnitude of this contact pressure. If, in reaction to an excessively high coating weight, only the amount of coating medium that is being dispensed by the applicator device within a given time period is reduced, that is while maintaining the same or substantially the same actuating force, the coating weight can be brought back to the predetermined desired value and the contact pressure of the metering element against the moving surface reduces accordingly. If, in reaction to a coating weight which is too low, only the actuating force exerted upon the metering element is reduced, while maintaining the same or substantially the same amount of coating medium being dispensed by the applicator device within a given time period, then the coating weight can be increased to the predetermined desired value, thereby correspondingly reducing the contact pressure exerted by the metering element against the moving surface. Thus, the method of the present invention adjusts to coating weights that are too high or too low in a manner that reduces wear and tear on the metering element.

The value of the actuating force exerted upon the metering element, as well as the amount of coating medium released by the applicator device within a given time period, may only be reduced within certain limits before negatively affecting the smoothness and the uniformity of the applied coating layer. The method of application of the present invention represents a simple method to return the operating parameters during the coating operation to predetermined values (i.e., a "relaxation mode") that ensure a good quality coating result while minimizing the wear and tear of the metering element. For example, if a lower limit for either the actuating force exerted upon the metering element and/or for the amount of coating medium dispensed by the applicator device within a given time period is reached or fallen below, then the operating parameters can be adjusted accordingly (i.e. the "relaxation mode" is exited).

The wear and tear occurring at the metering element can be decreased by reducing the amount of coating medium dispensed by the applicator device within a given time period and increasing the actuating force exerted upon the metering element only when the measured coating weight exceeds a predetermined desired value. Wear and tear occurring at the metering element can also be decreased by increasing the amount of coating medium dispensed by the applicator device within a given time period and decreasing the actuating force which is exerted upon the metering element only when the measured coating weight falls below a predetermined desired value. This is accomplished by keeping the contact pressure of the metering element constant relative to the moving surface by adjusting the actuating force or adjusting the amount of coating medium being dispensed by the applicator device within a given time period. The angle of attack of the metering element against the surface can also be adjusted to reduce wear and tear of the metering element.

It is recognized that a coating weight reduction is achieved by increasing the actuating force exerted upon the metering element, which is associated with an increase in the contact pressure. A reduction in the coating is also achieved by a reduction of the amount of coating medium dispensed by the applicator device within a given time period, which is associated with a reduction in the contact pressure. It is further recognized that a coating weight increase is achieved by either reducing the actuating force exerted upon the metering element, which is associated with a corresponding reduction of the contact pressure, or by increasing the amount of coating medium that is released by the applicator device within a given time period, which is associated with a corresponding increase in the contact pressure. Based on this, when a reduction or an increase in coating weight is desired, a substantially constant contact pressure of the metering element relative to the moving surface is maintained through appropriate control combinations of applicator device and metering element during coating weight increases or coating weight reductions.

This method is especially advantageous in cross profiling of the applied coating layer. In order to achieve the desired cross profile the contact conditions of the metering element against the moving surface are selected such that the contact pressure of the metering element relative to the moving surface is substantially uniform across the entire working width of the metering element, thus resulting in uniform wear across the working width of the metering element. This is of particular advantage because, conventionally, the life span of a metering element is limited by increased wear at only a few locations, resulting in replacement of the metering element when the majority of the working width thereof would still be usable.

Parallel considerations apply to a change in the angle of attack of the metering element against the moving surface. An increase in the adjustment force exerted on the metering element relative to the moving surface results in a stronger deflection of the metering element, or the mounting thereof, and thus the angle of attack of the metering element is reduced. Similarly, a stronger deflection of the metering element, or the mounting thereof and thus a reduction in the angle of attack of the metering element, results from an increase in the amount of coating medium being released by the applicator device onto the moving surface within a given time period. Parallel statements apply relative to a reduction of the adjustment force exerted on the metering element relative to the moving surface and the amount of coating applied.

By appropriate control combinations of applicator device and metering device, a state is achieved where the angle of attack of the metering element against the moving surface remains substantially constant, even during increases and decreases in the coating weight. This has a particularly positive effect on the quality of the applied coating. Most importantly however, the difficult and time-consuming readjustment procedure of the angle of attack of the metering device is avoided.

In practical application, metering element movements resulting from a variation in the force applied by the metering element on the moving surface are normally in a magnitude of millimeters, while the metering element movements resulting from a variation in the coating volume are in a magnitude of micrometers.

The previously discussed operating modes can be combined, i.e., the contact-pressure based operating mode and the angle of attack based operating mode. An example of such a combined operating mode is proportionally determining the actuating signals for the applicator device and the metering device through use of contact pressure oriented control and an angle of attack oriented control.

Yet another operating mode provides, for example, the simultaneous correction of the coating weight and the contact pressure with which the metering element is adjusted against the surface. The amount of coating (or the adjustment power) is adjusted dependent upon any deviation of the contact pressure from a desired value to an increased value. This additional deviation is compensated for by an appropriate change in the amount of coating being applied.

To enhance the measuring accuracy, the coating weight is measured by use of a sensor device. The sensor device may, for example, include at least one first basis weight sensor which would measure the basis weight of the material web prior to coating, at least one second basis weight sensor which would measure the basis weight of the material web after coating, and a subtraction device which calculates the coating weight from the difference between the basis weights measured by the second and the first basis weight sensors.

For cross profiling of the coating application, the sensor device measures the coating weight with local resolution, that is, it always determines a separate basis weight value for a multitude of sections adjacent to each other in a direction transverse to the direction of movement or rotation of the moving surface.

To automate the previously described method, a control unit is provided which, depending upon the measured coating weight, determines controller outputs to change the actuating force exerted upon the metering element and the amount of coating medium being released by the applicator device within a given time period. An input unit is assigned to this control unit with which an operator who has measured a deviation in the coating weight from a desired value inputs whether the coating weight should be increased or decreased. The control unit can alternatively be configured as a controller to which a coating weight signal is supplied from the sensor and which then, based on a database of desired values or desired value profiles, independently makes any required adjustments to the applicator device and the metering device, and monitors the success of the implemented adjustments on the basis of newly supplied coating weight signals.

The metering element is, in the embodiment shown, a doctor blade. However, the metering element can be alternatively configured as a smooth or profiled metering rod. All methods of the current invention may also be utilized to influence the cross profile, as well as the longitudinal profile of the coating layer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrate one preferred embodiment of the invention, in one form, and such exemplification is not to be construed as limiting the scope of the invention in any manner.

DETAILED DESCRIPTION OF THE INVENTION

Figure 1:
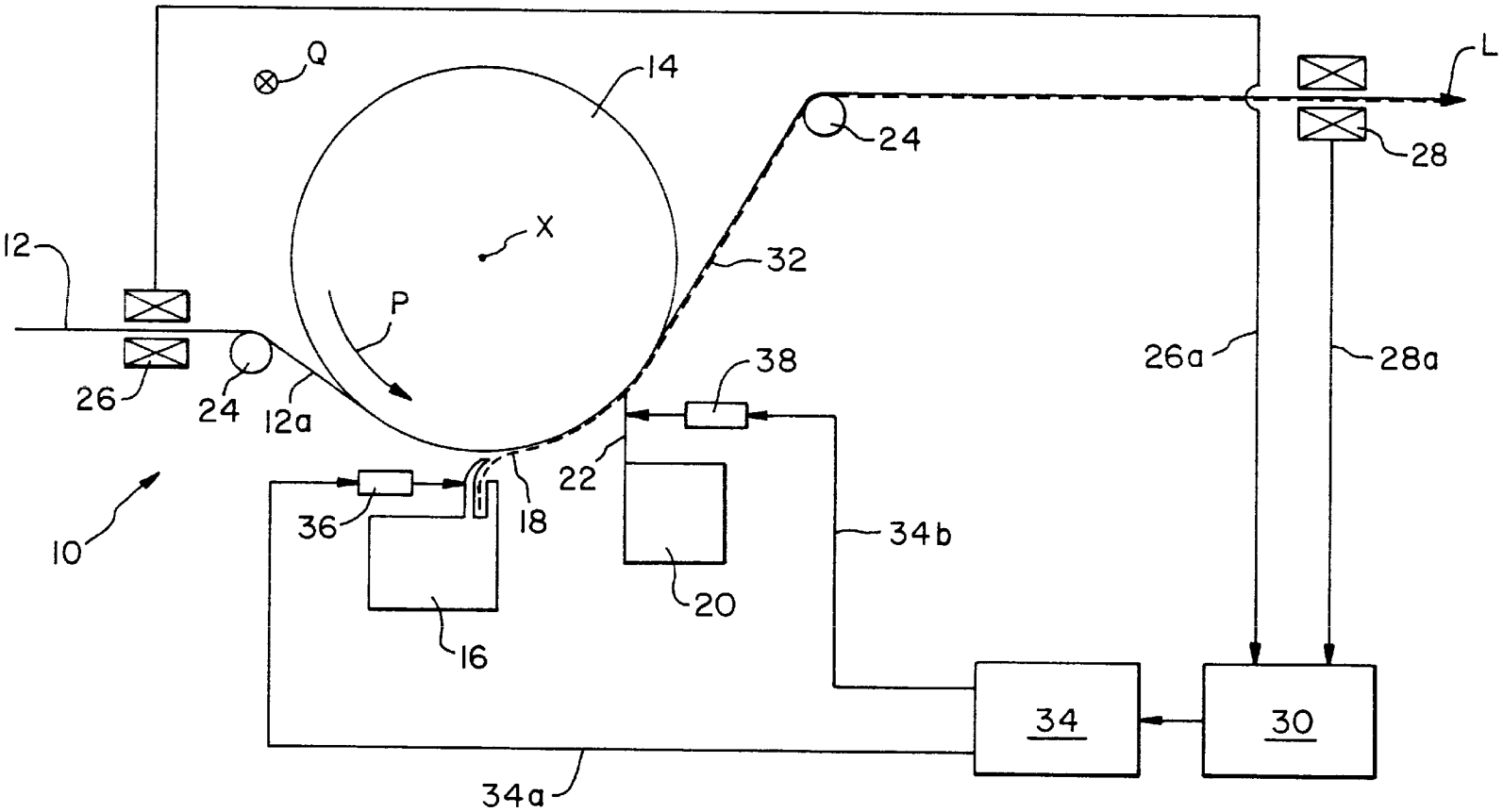
FIG. 1 is a schematic view of one embodiment of an applicator device for the performance of the coating method of the present invention.

Referring now to the drawings and particularly to FIG. 1, there is shown an applicator device 10 for the performance of the coating method of the present invention. In the area of applicator device 10, a material web 12 moving in direction of travel L is wrapped around backing roll 14 which rotates around axis X in rotational direction P. Liquid or viscous coating medium 18 is applied in excess to surface 12*a* of material web 12 by applicator device 16, such as a free jet nozzle applicator. Metering device 20, equipped with metering element 22, meters coating medium 18 that has been applied by applicator device 16 onto material web surface 12*a*. Metering device 20 removes excess coating medium 18 thereby smoothing and forming coating layer 32. During the metering process, the excess coating medium 18 removed by metering device 20 is collected and furnished to a coating medium reservoir (not shown), to be dispensed again by applicator device 16. Web turning rolls 24 are also illustrated.

Basis weight sensor arrangement 26 is provided prior to applicator device 10, relative to direction of travel L, and determines the basis weight of inflowing material web 12. Basis weight sensor arrangement 28 is disposed after applicator device 10 relative to direction of travel L. Basis weight sensor arrangement 28 measures the basis weight of exiting material web 12. Basis weight sensor arrangement 26 and 28 each supply a respective signal via signal lines 26*a* and 28*a* respectively to subtraction device 30 in which the basis weight of coating layer 32 is calculated. The coating weight which has been applied by applicator device 10 onto material web 12 is calculated from the difference of the basis weight on the exit side, as determined by sensor arrangement 28, and the basis weight on the inlet side, as determined by sensor arrangement 26.

A corresponding coating weight signal is supplied to control unit 34 which compares the actual coating weight supplied by subtraction device 30 to a desired coating weight which is stored in a data base. Should control unit 34 decide that the actual coating weight is too high or too low, it provides appropriate actuating signals via signal lines 34*a* and 34*b* to control device 36 which is assigned to the applicator device 16, and to control device 38 which is assigned to metering device 20. Control device 36 adjusts the amount of coating medium 18 being dispensed by applicator device 16 within a given time period. Control device 38 adjusts the actuating force exerted on metering element 22. Thus, control devices 36 and 38 each influence the coating weight of coating layer 32.

Sensor arrangements 26 and 28 also determine the basis weight of material web 12 based upon local resolutions, i.e., sensor arrangements 26 and 28 determine separate basis weight values for a multitude of neighboring sections of material web 12 in cross direction Q. Correspondingly, subtraction device 30 determines the coating weight based on local resolutions, and provides a coating weight profile to controller 34. Control devices 36 and 38 exert local resolution-based influence over the actuating force exerted on metering element 22 and/or the amount of coating medium 18 dispensed within a given time period by applicator device 16, as triggered by controller 34.

Triggering of control devices 36 and 38 by controller 34 occurs dependent upon a certain coating weight deviation and dependent upon the selected mode of operation, i.e., the relaxation mode, the contact pressure based mode, the angle of attack based operating mode, or a combination thereof.

Figure 2:
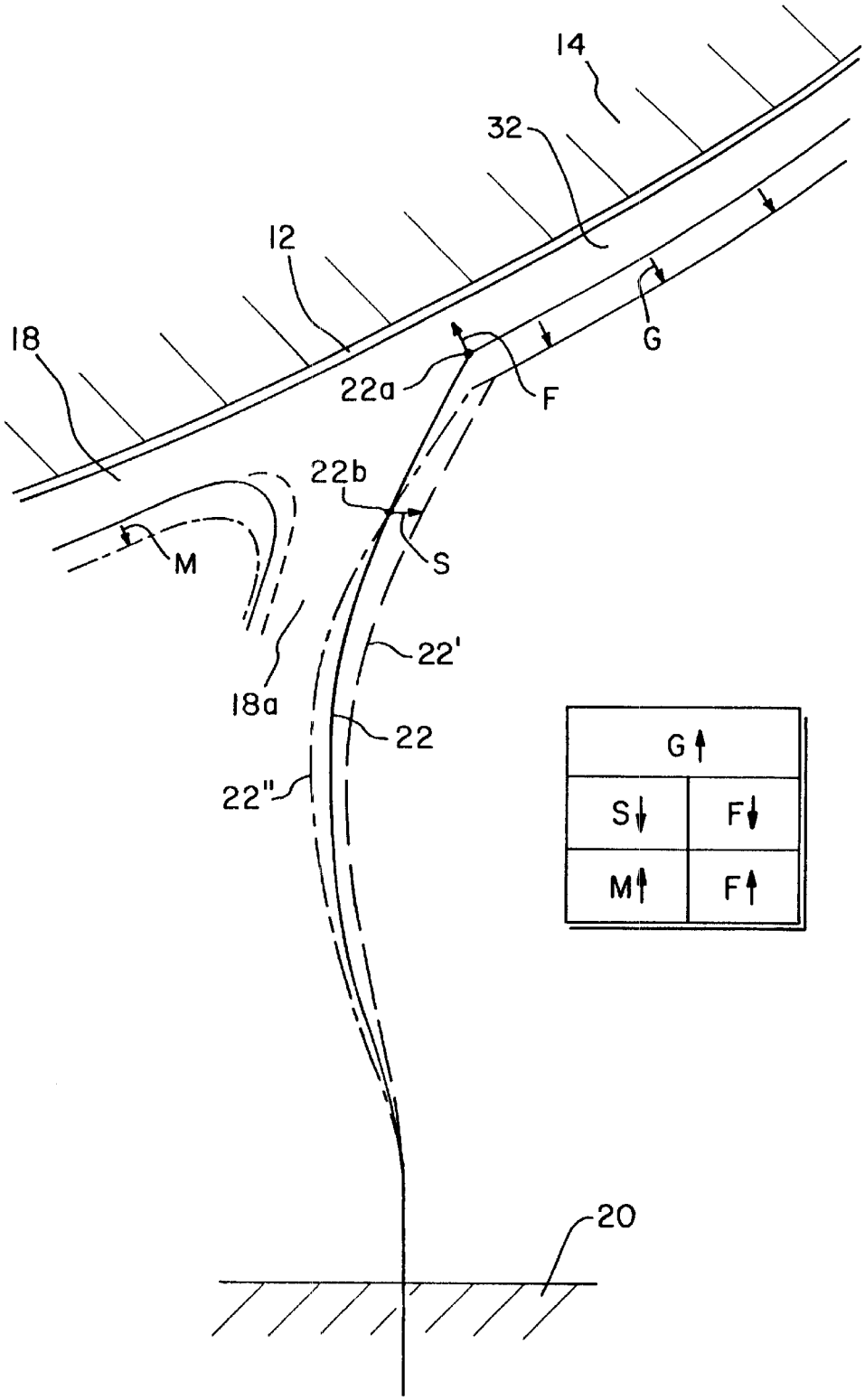
FIG. 2 is an enlarged schematic view illustrating the effects of an increase in the coating weight on the apparatus of FIG. 1, practicing the coating method of the present invention.

FIG. 2 illustrates an enlargement of the area of metering device 20. The illustration is not to scale and is somewhat exaggerated with regard to layer thicknesses and bending of doctor blade 22. Doctor blade 22 is adjusted having free end 22*a* against material web 12, which is wrapped around roll 14, in order to meter and smooth coating medium 18 applied by applicator device 16 to material web 12, with the purpose of achieving coating layer 32 having a desired coating weight. For this purpose doctor blade 22 is adjusted against material web 12 with free end 22*a* thereof having a contact pressure F.

The increase of coating weight G is achieved by reducing actuating force S exerted at contact point 22*b* on doctor blade 22. Doctor blade 22 has a starting position illustrated by showing doctor blade 22 in a solid line. Reducing actuating force S, as indicated by arrow S, effectively moves doctor blade 22 from its starting position (solid line) into the position indicated by the broken line showing doctor blade 22 in position 22'. The reduction of actuating force S is associated with a simultaneous reduction in contact pressure F exerted by blade tip 22*a* upon the material web 12, or coating medium 18. A corresponding change of the running of coating medium 18, or excessive amount 18*a* running off the doctor blade 22, is also shown in FIG. 2 in a broken line.

An increase in coating weight G is also achieved by increasing the amount of coating medium 18, as indicated in FIG. 2 by arrow M, being dispensed within a given time period by applicator device 16. The increase in coating volume M, while keeping constant the engagement of control device 38 at the angle of attack 22*b* of doctor blade 22, results in a greater deflection of doctor blade 22, as illustrated in FIG. 2 by showing doctor blade 22 in position 22". The increase in the coating volume M is associated with an increase in contact pressure F.

If low stress of the doctor blade 22 is desired, and an increase of coating weight G is desired then the relaxation mode will achieve the desired increase in coating weight G by reducing actuating force S. However, if uniform wear and tear of doctor blade 22 is the prime consideration, an increase in coating weight G is achieved by a combination of reducing contact pressure F, which lowers actuating force S, and increasing the amount of coating medium 18 dispensed within a given time period, which increases contact pressure F.

Figure 3:
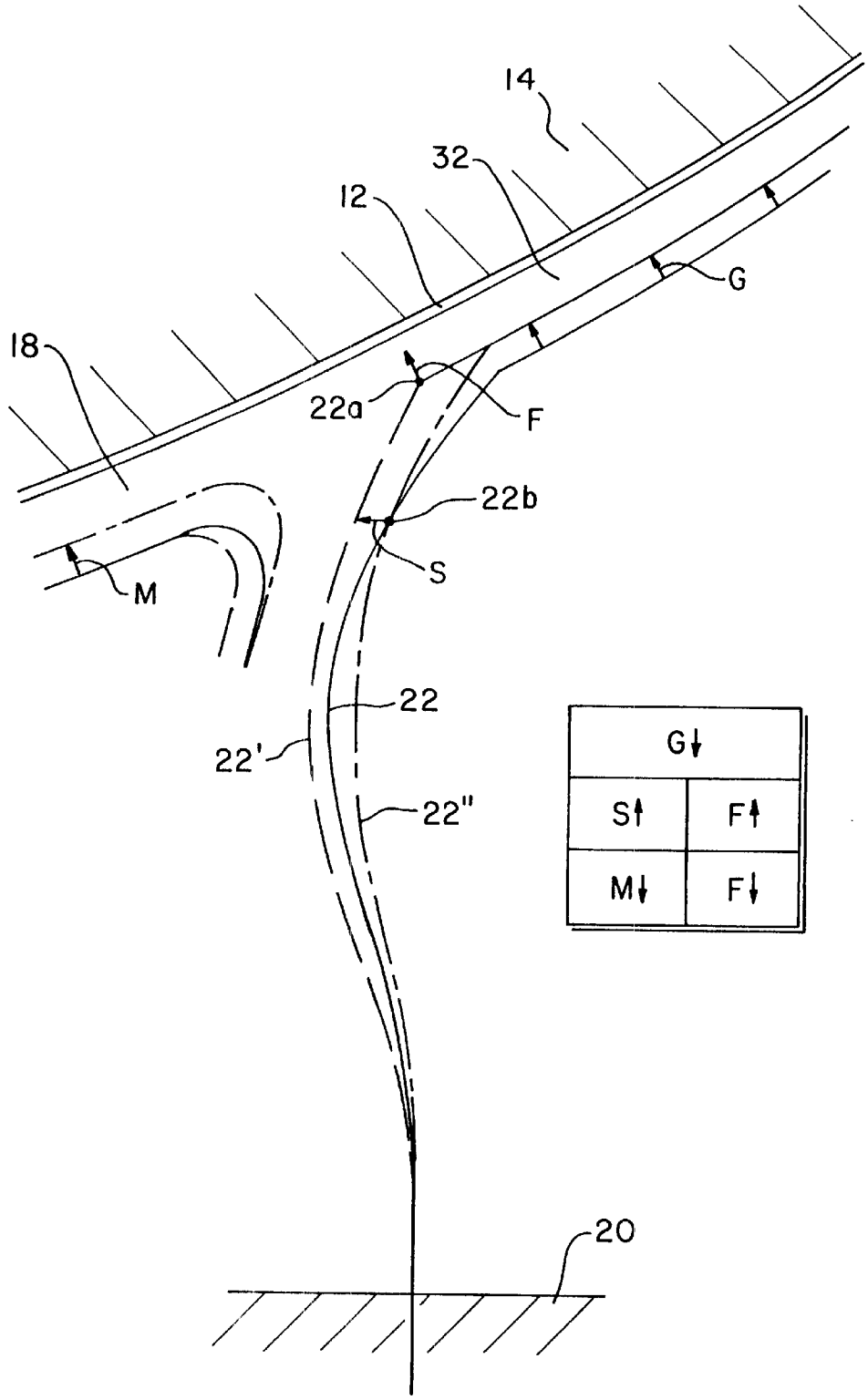
FIG. 3 is an enlarged schematic view illustrating the effects of a decrease in the coating weight on the apparatus of FIG. 1, practicing the coating method of the present invention.

FIG. 3 illustrates the situation when a reduction of coating weight G in coating layer 32 is required. Such a reduction in coating weight G is achieved by increasing actuating force S exerted at contact point 22*b* on doctor blade 22. Doctor blade 22, shown in FIG. 3 as a solid line, is effectively moved from its starting (solid line) position into the position indicated by broken line 22'. The increase of actuating force S is associated with a simultaneous reduction in contact pressure F exerted by blade tip 22*a* on material web 12, or coating layer 32.

A decrease in coating weight G may also be achieved by decreasing coating volume M of coating medium 18 that is dispensed within a given time period by applicator device 16. In this instance doctor blade 22 moves from the position indicated by broken line 22' in FIG. 3 to the position indicated by the dot-dash line 22". The decrease in coating volume M is also associated with a decrease in contact pressure F.

In the relaxation mode of operation, reduction of coating weight G is accomplished by a reduction in coating volume M. In the contact pressure based operating mode, however, reduction of coating weight G is accomplished by a combination of increasing actuating force S and decreasing coating volume M. Similar measures apply to the angle of attack based operating mode.

Although reference was made in the aforementioned material to metering element 22 being configured as a doctor blade, it must be pointed out that other metering elements, such as, for example, smooth or profiled metering rods, can be used. Also, it is to be understood that, in addition to free jet nozzle applicator devices, any other type of applicator device which permits adjustment of the volume of coating medium dispensed within a given time period may be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for one of direct and indirect application of a coating medium onto a moving material web, said material web being one of a paper web and a cardboard web, said method comprising the steps of applying the coating medium onto the moving material web with an applicator device, a volume of the coating medium applied within a predetermined time period being adjustable;

associating a metering element with the moving material web, said metering element being disposed after said applicator device relative to a direction of travel of the moving material web;

exerting an adjustable actuating force upon said metering element to thereby meter the applied coating medium;

measuring a coating weight of the coating medium applied to the moving material web;

comparing said measured coating weight to a predetermined desired value;

reducing the volume of the coating medium applied and concurrently maintaining a substantially constant actuating force within said predetermined time period when said measured coating weight exceeds said predetermined desired value; and reducing said adjustable actuating force exerted upon said metering element and concurrently maintaining a substantially constant volume of the coating medium when said measured coating weight is less than said predetermined desired value.

2. The method of claim 1, comprising the further step of ceasing said method when at least one of said volume of the coating medium being applied to said moving material web within said predetermined time period and said adjustable actuating force exerted upon said metering element falls below a predetermined level.

3. The method of claim 1, wherein said coating weight exceeds said predetermined desired value, comprising the further step of maintaining at a substantially constant value at least one of a contact pressure and an angle of attack of said metering element relative to the moving material web by reducing said volume of coating medium dispensed within said predetermined time period and increasing said adjustable actuating force exerted upon said metering element.

4. The method of claim 1, wherein said coating weight falls below said predetermined desired value, comprising the further step of maintaining at a substantially constant value at least one of a contact pressure and an angle of attack of said metering element relative to the moving material web by increasing said volume of coating medium dispensed within said predetermined time period and reducing said adjustable actuating force exerted upon said metering element.

5. The method of claim 1, wherein said measuring step includes measuring said coating weight with at least one sensor device.

6. The method of claim 5, wherein said at least one sensor device includes at least one first basis weight sensor measuring a first basis weight of the moving material web prior to coating, at least one second basis weight sensor measuring a second basis weight of the moving material web after coating, and a subtraction device which calculates said coating weight based upon a difference between said first basis weight and said second basis weight.

7. The method of claim 5, wherein said at least one sensor device determines a basis weight value for a plurality of adjacent sections of the moving material web, said plurality of adjacent sections being substantially aligned in a transverse direction relative to the direction of travel of the moving material web.

8. The method of claim 1, comprising the further steps of:

issuing at least one control signal, said at least one control signal being dependent upon said coating weight; and controlling at least one of said actuating force and said volume of coating medium dispensed within said predetermined time period based at least in part upon said at least one control signal.

9. The method of claim 8, wherein said controlling step further includes ceasing said method dependent at least in part upon said at least one control signal.

10. The method of claim 1, wherein said metering element comprises one of a doctor blade and a metering rod.

11. The method of claim 1, comprising the further step of adjusting a profile of the coating medium in at least one of a transverse direction relative to the direction of travel of the moving material web and a parallel direction relative to the direction of the moving material web.

* * * * *